United States Patent [19]

Breen

[11] Patent Number: 4,973,058

[45] Date of Patent: Nov. 27, 1990

[54] EDUCATIONAL WORD GAME AND METHOD OF PLAY

[75] Inventor: Richard J. Breen, Coral Gables, Fla.

[73] Assignee: One-On-One Learing Systems Partnership, Woodland Hills, Calif.

[21] Appl. No.: 335,851

[22] Filed: Apr. 10, 1989

[51] Int. Cl.[5] ..... A63F 3/00; A63F 3/06

[52] U.S. Cl. ..... 273/240; 273/272; 273/269

[58] Field of Search ..... 273/240, 272, 236, 299, 273/269; 434/157

[56] References Cited

U.S. PATENT DOCUMENTS

| | | | |
|---|---|---|---|
| 1,491,536 | 4/1924 | Kaufman | 273/272 |
| 3,271,884 | 9/1966 | Roberson | 434/157 |
| 3,464,124 | 9/1969 | Lynd | 273/269 |
| 3,602,513 | 8/1971 | Breen | 273/240 |
| 3,877,703 | 4/1975 | Pierre | 273/272 |
| 4,000,897 | 1/1977 | York | 273/93 C |
| 4,591,161 | 5/1986 | Vanderhoof | 273/272 |

OTHER PUBLICATIONS

Hahn Shoes Checker Game 1967.

*Primary Examiner*—Benjamin Layno

*Attorney, Agent, or Firm*—Epstein, Edell & Retzer

[57] ABSTRACT

The word game of my prior U.S. Pat. No. 3,602,513 is improved by providing individual point scores for each word in meaningfully paired words. The point score for each word is inversely related to the frequency of occurrence of its letters in all words of the game, and is directly related to the number of letters in the word.

20 Claims, 2 Drawing Sheets

FIG. 1

OPPOSITES ATTRACT GAME 1

PLAYER CARD 1, SIDE A

6 S O F T
8 H A R D
6 O V E R
9 U N D E R
8 W A R M
5 C O O L
4 U P
6 D O W N
6 D R Y
5 W E T

FIG. 2

PLAYER CARD 1, SIDE B

6 S O F T
5 W E T
6 O V E R
6 D O W N
8 W A R M
8 H A R D
4 U P
9 U N D E R
6 D R Y
5 C O O L

FIG. 3

OPPOSITES ATTRACT GAME 1

PLAYER CARD 2, SIDE A

9 S W E E T
5 S O U R
8 P U S H
8 P U L L
4 T O P
8 B O T T O M
9 H I G H
4 L O W
5 I N
3 O U T

FIG. 4

PLAYER CARD 2, SIDE B

9 S W E E T
8 B O T T O M
8 P U S H
3 O U T
4 T O P
8 P U L L
9 H I G H
5 S O U R
5 I N
4 L O W

FIG. 5a
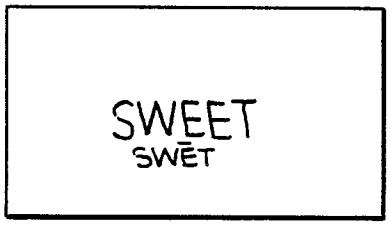
FIG. 5b
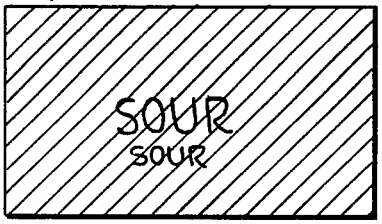
FIG. 6a
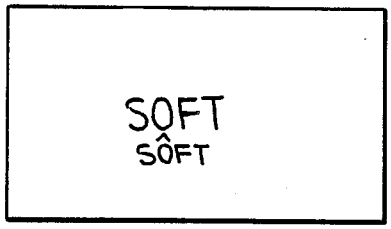
FIG. 6b
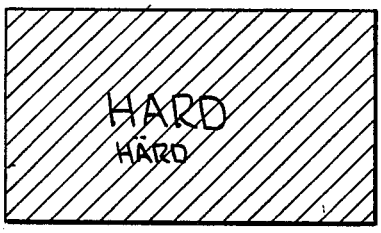
FIG. 7
SCORE CARD
SIDE A
PLAYER NAMES _____
| | | |
|---|---|---|
| LINE 1 | | |
| LINE 2 | | |
| LINE 3 | | |
| LINE 4 | | |
| LINE 5 | | |
| TOTAL GAME 1 SIDE B | | |
| LINE 1 | | |
| LINE 2 | | |
| LINE 3 | | |
| LINE 4 | | |
| LINE 5 | | |
| TOTAL GAME 2 | | |
| PLUS TOTAL GAME 1 | | |
| GRAND TOTAL | | |
FIG. 8
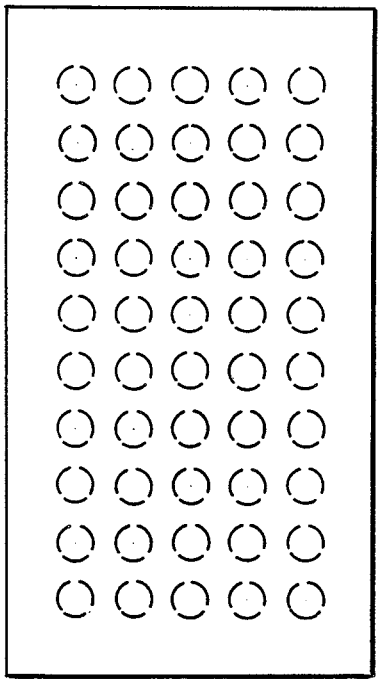
FIG. 9
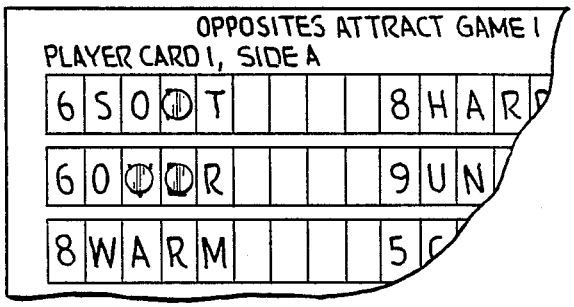

EDUCATIONAL WORD GAME AND METHOD OF PLAY

BACKGROUND OF THE INVENTION

1. Technical Field:

The present invention relates to improvements in educational word games and, more particularly, is an improvement of the game disclosed in my prior U.S. Pat. No. 3,602,513.

2. Discussion of the Prior Art:

The game that is the subject of my aforesaid patent provides plural player cards (i.e., one per player), each having ten different pairs of words. On one side of the player card each pair of words is positioned on a respective line, and each line is provided with a point score appearing between the paired words which have the same meaning in two different languages (e.g., English and Spanish). A stack of word cards includes one card for each word appearing on the player cards, the paired words of the player cards appearing on opposite sides of respective word cards. The game is played one line at a time on each player card by sequentially turning over word cards from the stack. As a word card is turned, each player selects one letter from the exposed word and blacks out that letter each time it appears in both of the paired words of the line being played on his/her player card. The blacking out step is effected with a grease pencil employed to mark out a portion of a transparent acetate sheet covering the player card. If all of the word cards in the stack are turned over before play is completed, the stack is itself turned over and shuffled so that all of the words on the opposite sides of the word cards may be sequentially exposed. The first player to black out all of the letters in one of the paired words on the currently played line may elect to terminate play of the current line and receive the point score appearing on that line. Alternatively, that player may elect to continue playing the line with the intention of blacking out all letters in both of the paired words in order to achieve a point total corresponding to quadruple the indicated point score for the line being played. In doing so, however, the player risks forfeiting all points for the current line if an adversary blacks out one or both words on the adversary's current line before the first player covers both of his/her words. After one player scores for the current line, the word cards are shuffled and the players proceed to the next line on their respective player cards until all of the lines on the first side of the player cards have been played. The player cards are then turned over to their reverse sides on which the same words appear but are not properly paired on common lines; e.g., the Spanish translation of an English word does not appear on the same line as the English word having the same meaning. Play continues as described for the first side of the player cards; however, a "played line" on the reverse side must include properly paired translations. If, for example, a player fills in all of the letters of an English word but has unknowingly been playing the wrong Spanish word, that player, upon electing to take the point score, is penalized that point score amount. In this regard, before a player can win a line, that player must cover one word plus at least one letter of the properly paired translation word. Of course, the players can elect to seek quadruple line point score by covering all of the letters in two properly paired translation words. After all lines are played on both sides of the player cards, the player with the highest accumulated point score is declared the winner.

The game of my prior patent, as described above, is both interesting to play and educational for its players. However, there are certain features of the game which are in need of improvement. For example, the assignment of point scores to each line is somewhat arbitrary in that no strict formula is applied. For example, the point score is selected by generally considering the number of letters in the paired words and the relative difficulty of the translation from English to Spanish in each pair of words. As a consequence, even though the same number of points may be assigned to each player card, certain player cards tend to be easier than others, thereby giving a distinct advantage to the players of the easier cards. Moreover, the assignment of a point score to a pair of words, while permitting a line to be won by blacking out just one of the words, fails to consider the relative difficulty of covering each of the words in the pair.

I have also found that my prior game may be adapted to have broader educational value than merely serving as a foreign language learning tool.

Finally, I have found an improved and inexpensive technique for covering letters in words during playing of the game such that inadvertent marking of clothing and furniture with a grease pencil, particularly by young children, is avoided.

OBJECTS AND SUMMARY OF THE INVENTION

It is therefore an object of the present invention to improve the word game disclosed in my aforementioned U.S. Pat. No. 3,602,513. In particular, it is an object of the present invention to improve the scoring procedure in that game to make the game more interesting and exciting for the players while retaining, and even expanding, the educational value of the game.

A more specific object of the present invention is to provide an improvement to the game described above wherein point scores assigned to words reflect the degree of difficulty involved in covering all of the letters in those words.

It is another object of the present invention to provide an improved technique for marking individual letters while playing my aforesaid game.

In my improved game, paired words may be synonyms, rhymes, antonyms, geographically-related (e.g., states and capital cities), translations from different languages, or any pairing according to the educational subject to be treated. In accordance with the present invention, point scores are assigned to individual words, rather than to pairs, on the bases of the frequency of occurrence of the letters in the word cards and the number of letters in the words. Then, by apportioning the words to player cards such that all player cards have the same number of total points, there is no built-in bias favoring one player card over another.

In a preferred embodiment of the present invention the point scores assigned to words are achieved by first counting the occurrences of all letters in the words appearing on all player cards. The letters are then given a weighted value that is inversely related to their frequency of occurrence. For example, if the number of occurrences of the most frequently occurring letter is N, then the weighted value x assigned to each letter might be $x=N+1-n$, where n is the number of occurrences of the letter being weighted The weighted values x assigned to each letter are then summed in each word to provide respective weighted word sums S which, if desired, may be used as the point scores for respective words. However, since these sums tend to be rather large, in order to simplify the tallying of scores for young players of the game, weighted word sums may be reduced by a constant factor. In this regard, I have found that a particularly effective factor is the number three divided by N, whereby the point score P for each word would be $P=3S/N$.

BRIEF DESCRIPTION OF THE DRAWINGS

These and other objects, features and many of the attendant advantages of the present invention will be appreciated more readily as they become better understood from a reading of the following description considered in connection with the accompanying drawings wherein like parts in each of the several figures are identified by the same reference characters, and wherein:

FIG. 1 is a plan view of one side of a first player card used in the game of the present invention;

FIG. 2 is a plan view of the opposite side of the player card illustrated in FIG. 1;

FIG. 3 is a plan view of one side of a second player card used in the game of the present invention;

FIG. 4 is a plan view of the opposite side of the player card illustrated in FIG. 3;

FIG. 5*a* is a plan view of one side of a word card used in the game of the present invention;

FIG. 5*b* is a plan view of the opposite side of the word card illustrated in FIG. 5*a;*

FIG. 6*a* is a plan view of one side of a second word card used in the game of the present invention;

FIG. 6*b* is a plan view of the opposite side of the word card illustrated in FIG. 6*a;*

FIG. 7 is a plan view of a score card used in the game of the present invention;

FIG. 8 is a plan view of a card containing punch-out markers used in the game of the present invention; and FIG. 9 is a broken perspective view in detail showing some of the letters of a player card covered with markers from the marker card illustrated in FIG. 8.

DESCRIPTION OF THE PREFERRED EMBODIMENTS

Referring specifically to FIG. 1 of the accompanying drawings, a playing card 10 used in the game of the present invention is illustrated with its side A facing up. The A side has five word lines, each divided into a series of character spaces. The character space at the left end of the line contains the point score for the first word of the line, the latter beginning in the second character space. It is to be noted that if double digit point scores are employed, two character spaces are reserved for this purpose. In either case, the point scores for the first words in the five lines are arranged in a column as are the first letters of these words. The point scores for the second words in each line are similarly arranged in a column, as are the first letters for these second words. In the example illustrated for card 10, the paired words on each line of side A are antonyms, namely: "soft-hard"; "over-under"; "warm-cool"; "up-down"; and "dry-wet". The method for deriving the point scores indicated for each of these words will be described subsequently.

Side B of card 10 is illustrated in FIG. 2 and is subdivided into word lines and character spaces in the same manner as side A. The words in the left column of side B appear in the same order as on side A; however, the order in the right column of words is changed so that no antonym pair appears on the same word line. Sides A and B are preferably provided with different background colors in order that they may be readily visibly distinguished.

Side A of a second player card 11 is illustrated in FIG. 3. The arrangement of word lines and character spaces is identical to player card 10 but a different set of antonyms and corresponding point scores appears on card 11. Thus, the antonym pairs on card 11, side A, are: "sweet-sour"; "push-pull"; "top-bottom"; "high-low"; and "in-out". Likewise, side B of card 11, illustrated in FIG. 4 has the same words as side A with the right column out of order so that no two antonym pairs appear on the same word line.

For each word pair appearing on a player card 10, 11, there is a respective individual word card 12 of the type illustrated in FIGS. 5*a* and 5*b* and in FIGS. 6*a* and 6*b*. On one side of each word card 12 there is a respective word from the left column of a player cards 10, 11, while the matching antonym appears on the opposite side of the word card. Thus, the word "sweet" appears on one side of word card 12 of FIG. 5*a,* while on the opposite side of that card the word "sour" appears as illustrated in FIG. 5*b*. Likewise, one side of card 12 in FIG. 6*a* contains the word "soft" while the opposite side, illustrated in FIG. 6*b*, contains the word "hard". It will be appreciated that if there are only two player cards 10, 11 then there will be a total of twenty words (i.e., ten per card). Therefore, there will be ten word cards 12, one for each pair of words. Of course, if there are more player cards, then there will necessarily be more word cards. It is also preferable that the two sides of the word cards be provided with different background colors to distinguish the left column words from the right column words as they appear on the player cards. Moreover, the background colors on the word card should preferably match the background colors on sides A and B of the player cards, whereby the background color of side A of the player card is the same as the background color of the side of the word card that contains the left column word.

A marker card 15 is illustrated in FIG. 8 and is provided with multiple circular (or other configurations) perforations to define multiple respective markers 16 that can be punched out of card 15. Markers 16 are used in playing the game to cover individual letters, rather than using a grease pencil and a transparent acetate sheet as provided in the game described in my prior patent.

In playing the game of the present invention, each player begins by playing side A of a respective player card. For purposes of this example it is assumed that there are two players, one playing player card 10, the other playing player card 11. Each player starts with the top line of side A of his/her card, so that the first player initially plays the line containing the "soft-hard" word pair while the second player plays the line containing the "sweet-sour" word pair. The word cards 12 are stacked, such that the surfaces of the same background color face upward, and then shuffled by the dealer. The word cards 12 are then turned over by the dealer, one at a time, and placed in a discard stack. Thus, assuming the surfaces shown in FIGS. 5*a* and 6*a* are facing up, and assuming that the first card in the shuffled stack is the card illustrated in FIGS. 5*a* and 5*b*, the word "sweet" is exposed at the top of the stack of word cards. When this card is turned over, the word "sour" is exposed at the top of the discard stack. The dealer calls out each turned over word (i.e., in this case "sour"). Each player may then select one letter from the exposed word card and covers that letter with a marker 16, as illustrated in FIG. 9, wherever that letter appears in the two words of the line being played. For example, the player of card 10 may select the letter "o" from the word "sour" and cover that letter in the word "soft". The other player may select the letter "s" from the word "sour" and cover that letter in the words "sweet" and "sour" on the player card 11. The players may select the same or different letters from the exposed word in the word card discard stack. The choice of letters is a strategically important aspect of playing the game for reasons to be discussed hereinbelow.

Once a player has covered all of the letters in one of the two paired words on the line being played, that player can choose to end the round (i.e., end play for the current line) and accept the point score associated with the covered word. For example, if the player of card 10 covers the word "soft" before the other player covers either "sweet" or "sour", the first player may accept the six points associated with "soft" and then the players proceed to the next round or line. However, a player may choose not to end the round when a single word is covered but instead may attempt to cover all letters in both paired words of the line being played. If a player covers both words of a line before another player covers one or both words, the first player receives double the point score for both words on the line. Thus, if the player of card 10 covers "soft" and "hard" before the player of card 11 covers either "sweet" or "sour", then the first player receives twenty-eight points; that is, six points for "soft" and eight points for "hard", doubled. If the first player elects to try to cover both words, he/she cannot then revert to acceptance of the single word point score. Also, if the first player elects to try to cover both words but has not yet done so when the other player covers one word, the other player has the option of ending the round and accepting the single word point score or attempting to cover both words before the first player does the same.

It will sometimes occur that more than one player will cover an entire word (or both words) on the same turn (i.e., by electing a letter from the same overturned word card). One way of handling this is to award both players their appropriate point scores. Alternatively, a player who covers a word may be required to call out a signal word (i.e., "winner"; "bingo", etc.) so that the first player to call out the signal word earns the point score for the line being played.

The point scores for each player are accumulated from line to line. When all the cards from the word card stack have been turned over, the deck is shuffled and then turned over so that the words on the reverse side are exposed in sequence.

After all lines on side A of the player card have been played, the player cards are turned over to side B. As noted above, on side B the words in the left column are listed in the same order as on side A, but the matching words in the right column are scrambled or misarranged. In playing side B the players must play each line using a word from the left column and its proper match in the right column wherever it appears. The playing of side B otherwise proceeds in the same manner as for side A, but in order to win the line point score, a player must cover one entire word plus at least one letter in the proper matching word. For example, if the player of card 10, side B, is playing the first line, he/she must cover all letters in the word "soft" and at least one letter in the word "hard"; alternatively, he/she must cover all letters in the word "hard" and at least one letter in the word "soft". If a player elects to accept the point score but has not properly matched the words, that player has the appropriate point score deducted from his/her accumulated total. Thus, if the player elects to end the round after covering one word plus one letter of a wrongly matched word, that player has the point score for the covered word deducted from his/her total. If the election is made after two wrongly matched words are entirely covered, the electing player loses double the sum of the point score for the two wrongly matched words.

After all lines on both sides A and B of the player cards have been played, the player with the highest accumulated point total is declared the winner.

An important aspect of the present invention relates to the manner in which point scores are assigned to the individual words. In particular, it is important that the point score for a word be related inversely to the frequency of occurrence of its letters and directly to the number of letters in the word. There are many techniques and formulae for accomplishing this and the present invention is not limited to any single technique or formula. However, a preferred formula, which is embodied in the point scores listed in cards 10 and 11, is described immediately below.

In accordance with the preferred embodiment of the present invention, it is necessary to obtain the total number of occurrences of each of the letters in all of the words of all of the player cards. If we assume for the present example that only cards 10 and 11 are to be considered, then twenty words must be examined and the total number of occurrences of each letter in these words is tallied. The most frequently occurring letter is then determined, and its number of occurrences is assigned a value N. Among the twenty words on player cards 10 and 11 in the illustrated example, the letter "o" is the most frequently occurring, and it occurs a total of eleven times. Therefore, for the present example, N is equal to eleven. Then, to obtain a reference value R, a constant C is added to N, resulting in a reference value $R=N+C$. In the preferred embodiment of the invention, the value of the constant C is one, so the reference value R for the illustrated example is eleven plus one, or twelve. Each letter is then assigned a weighted value x by subtracting its number of occurrences from the reference value R, resulting in the formula $x=R-n$, where n is the number of occurrences for the letter whose weighted value x is being computed. For example, the letter "h" occurs four times in the twenty words (i.e., $n=4$); therefore, its weighted value x is eight (i.e., twelve minus four).

When the weighted value x for all letters has been computed, these values are summed in each word to arrive at a weighted word sum S for each word. This weighted word sum may be used as the point score for each word, in which case the point scores, for the words on player cards 10 and 11 in FIGS. 1 and 3, would be as indicated in Table I under the column designated S. However, as noted from Table I, these values for S tend to be relatively high and may present difficulty for young players in adding accumulated point scores Accordingly, it is desirable to proportionally reduce each weighted sum S by a fixed constant factor. I have found that a meaningful factor for this purpose is either 3/N, or 3/(N+1), where N, as described above, is the highest number of occurrences for any letter in all of the words in the game. In the present example, with N=11, the factor is more easily applied by using the factor 3/(N+1)=3/12=0.25. The weighted sum S for each word is multiplied by the this factor and rounded to the nearest whole number to provide the point scores P shown in FIGS. 1, 2, 3 and 4 and in Table I.

Once the point scores are assigned to each word, the word pairs are assigned to player cards such that the total point score is the same, or substantially the same, for each player card.

It will be appreciated that, in playing the game, a player should not pick letters capriciously from the turned over word card 12. Specifically, it is desirable to cover the less frequently occurring letters on the player card as quickly as possible. For example, for the two player cards 10, 11 illustrated in FIGS. 1–4, the player who is playing card 11 is well advised to choose the letter "b" when playing the third line, side A, if the word "bottom" is exposed from the word card deck. More particularly, the letter "b" occurs only once and will not appear again in the word card stack until the deck is exhausted for the current side and then again on the opposite sides of the word cards.

As indicated above, the nature of the paired words used to play the game of the present invention depends upon the educational subject to be taught. For example, in order to demonstrate how the same sound may be achieved with different spellings, the paired rhymes illustrated in Table II may be employed. The words in the table are grouped such that the first five lines are on side A of one card and the second five lines appear on side A of another card. Side B of each card is obtained by scrambling the order in the right column. In this example, it can be determined that N=9 (i.e., the letter "e" occurs 9 times) R=10, and P=3S/N=S/3.

Still another example of paired words appears in Table III wherein the words are synonyms and at a level of considerably greater difficulty than the antonyms and rhymes described above. In this example N=24 (i.e., the letter "i" occurs twenty-four times), R=25 and P=3S/(N+1)=0.12S.

It will be appreciated that any manner of pairing words can be employed in the game of the present invention and that the difficulty level can be chosen as desired. The particular formulae described above for assigning point scores are quite efficient and desirable, but other formulae may be employed as long as they ascribe point scores that are inversely related to the frequency of occurrence (in the game) of the letters contained in the word. In addition, the length of the word must also be a factor in the formula. It will be appreciated that as the value of C (and, therefore, R) is increased in the described formulae, the weighing of the number of letters is increased relative to the frequency of occurrence of the letters. On the other hand, if the constant factor for deriving P from S is increased, the frequency of occurrence of letters is more heavily weighted. Other manipulations and formulations for differently weighing the number of letters and frequency of letter occurrence will become evident upon studying the concepts disclosed herein.

The educational word game of the present invention is particularly suited for use as part of a continuing learning program whereby games of increasing word difficulty are successively made available to students. For example, a game containing two player cards may be made available to the beginner student and would contain words typically suitable for first graders in the beginning of their first semester. Some weeks later a game containing slightly more difficult first grade words would be made available, and so on. The games would include two or more player cards, and the point scores would always be inversely related to the frequency of occurrence of letters employed on only those cards. The games may be made available through schools, by private subscription, through retail outlets, etc.

In the foregoing description it will be appreciated that the present invention makes available a novel game constituting an improvement of my prior patented game, wherein the point scores for each word are closely related to the difficulty of covering all of the letters in the word.

Having described preferred embodiments of a new and improved game in accordance with the present invention, it is believed that other modifications, variations and changes will be suggested to those skilled in the art in view of the teachings set forth herein. It is therefore to be understood that all such variations, modifications and changes are believed to fall within the scope of the present invention as defined by the appended claims.

TABLE I

| Word | P | S | Word | P | S |
|---|---|---|---|---|---|
| Soft | 6 | 25 | Hard | 8 | 32 |
| Top | 4 | 14 | Bottom | 8 | 33 |
| Up | 4 | 14 | Down | 6 | 25 |
| Warm | 8 | 33 | Cool | 5 | 21 |
| Dry | 6 | 25 | Wet | 5 | 19 |
| High | 9 | 37 | Low | 4 | 16 |
| In | 5 | 19 | Out | 3 | 12 |
| Sweet | 9 | 34 | Sour | 5 | 21 |
| Over | 6 | 25 | Under | 9 | 36 |
| Push | 8 | 30 | Pull | 8 | 30 |

TABLE II

| Word | S | P | Word | S | P |
|---|---|---|---|---|---|
| Picks | 33 | 11 | Fix | 23 | 8 |
| High | 23 | 8 | Sky | 21 | 7 |
| Dew | 14 | 5 | Do | 10 | 3 |
| Dare | 17 | 6 | Hair | 19 | 16 |
| No | 11 | 4 | Know | 24 | 8 |
| Bear | 17 | 6 | Scare | 23 | 8 |
| School | 30 | 10 | Rule | 18 | 6 |
| Grow | 20 | 7 | Hoe | 9 | 4 |
| Blue | 22 | 7 | Blew | 20 | 7 |
| Try | 20 | 7 | Pie | 14 | 5 |

TABLE III

| Word | S | P | Word | S | P |
|---|---|---|---|---|---|
| Pernicious | 108 | 13 | Dangerous | 129 | 15 |
| Volubility | 147 | 18 | Glibness | 104 | 12 |
| Serrated | 99 | 12 | Toothed | 96 | 12 |
| Pestilent | 99 | 12 | Infectious | 108 | 13 |
| Inebriate | 90 | 11 | Intoxicate | 103 | 12 |
| Capacious | 105 | 13 | Spacious | 91 | 11 |
| Capricious | 110 | 13 | Whimsical | 120 | 14 |
| Hermitage | 119 | 14 | Sanctuary | 117 | 14 |
| Sanctimony | 122 | 15 | Hypocrisy | 129 | 15 |
| Trenchant | 111 | 13 | Incisive | 68 | 8 |

What is claimed:

1. An educational word game and learning system for two or more players utilizing a plurality of pairs of words, the words in each pair being related to one another by meaning or sound, the game comprising:

a set of player cards and a set of word cards;

each word card having a word of a respective pair of words imposed on one face thereof, the other word of that pair being imposed on the opposite face thereof;

each of the player cards having imposed on one face thereof left and right columns of words, each word of the left column being one word of a respective pair, each word of the right column being the other word of said respective pair, each word in the left column having its corresponding paired word in the right column on the same horizontal line, and a plurality of numbers indicating respective point scores for each word in said left and right columns;

each of the player cards having imposed on a second face thereof left and right columns of words, one column being a repetition of the corresponding column on said one face, the other column having the same words as the other column on said one face but arranged in a scrambled sequence so that the words appearing on the same horizontal line are not properly paired with one another, and a plurality of numbers indicating respective point scores for each word in said left and right columns;

wherein one word card is provided for each pair of words appearing on the player cards;

wherein the point score indicated for each word on said one side of said player cards is the same as the point score indicated for the same word on said second side of said player cards;

wherein the relative value of said point score for each word is inversely related to the number of times the letters in said each word appear in all of the words in said plurality of pairs of words.

2. The word game according to claim 1 wherein the relative value of said point score for each word is also directly related to the number of letters in said each word.

3. The word game according to claim 2 wherein the sum of the point scores indicated on said player cards is substantially the same for each player card.

4. The word game according to claim 3 wherein each letter in the alphabet is assigned a weighted value $x=N+C-n$, where N is the number of occurrences of the most frequently occurring letter in all of the words in said plurality of pairs of words, wherein C is a positive constant number, and wherein n is the number of occurrences of said each letter in all of the words in said plurality of pairs of words; and wherein the point score indicated for each word is a direct function of the sum S of the weighted values x for all of the letters in said each word.

5. The word game according to claim 4 wherein the point score indicated for each word is approximately 3S/N.

6. The word game according to claim 5 wherein C is equal to one.

7. The method of playing the word game according to claim 4 wherein each player is assigned a respective player card, said method comprising the steps of:

(a) sequentially exposing words imposed on the faces of said word cards;

(b) selecting, for each player, a letter from the exposed word and covering that letter wherever it appears, on the player card assigned to that player, in two of the paired words being played in the current round of the game;

(c) awarding, to the first player who covers all letters in one of the words of the paired words being played and who elects to terminate the current round, the point score indicated for said one word;

(d) awarding, to the first player who covers all letters in both words of the paired words being played before a point score being awarded pursuant to step (c), double the point scores indicated for said both words.

8. The method according to claim 7 wherein the covering of letters in step (b) includes covering the letters with respective markers.

9. The word game according to claim 4 further comprising a marker card having multiple perforations defined therein to provide respective multiple markers that may be selectively removed from said marker card and placed over respective letters on said player card.

10. The word game according to claim 1 wherein the sum of the point scores indicated on said player cards as substantially the same for each player card.

11. The word game according to claim 10 wherein each letter in the alphabet is assigned a weighted value $x=N+C-n$, where N is the number of occurrences of the most frequently occurring letter in all of the words in said plurality of pairs of words, wherein C is a positive constant number, and wherein n is the number of occurrences of said each letter in all of the words in said plurality of pairs of words; and wherein the point score indicated for each word is a direct function of the sum S of the weighted values x for all of the letters in said each word.

12. The word game according to claim 11 wherein the point score indicated for each word is approximately 3S/N.

13. The word game according to claim 11 wherein C is equal to one.

14. The method of playing the word game of claim 11 wherein each player is assigned a respective player card, said method comprising the steps of:

(a) sequentially exposing words imposed on the faces of said word cards;

(b) selecting, for each player, a letter from the exposed word and covering that letter wherever it appears, on the player card assigned to that player, in two of the paired words being played in the current round of the game;

(c) awarding, to the first player who covers all letters in one of the words of the paired words being played and who elects to terminate the current round, the point score indicated for said one word;

(d) awarding, to the first player who covers all letters in both words of the paired words being played before a point score being awarded pursuant to step (c), double the point scores indicated for said both words.

15. The method according to claim 14 wherein the covering of letters in step (b) includes covering the letters with respective markers.

16. The word game according to claim 1 further comprising a marker card having multiple perforations defined therein to provide respective multiple markers that may be selectively removed from said marker card and placed over respective letters on said player card.

17. The word game according to claim 1 wherein said set of player cards consists of two player cards, and wherein the relative value of said point score for each word is inversely related to the number of times the letters in said each word appear on said two player cards.

18. A series of word games according to claim 1 wherein the words imposed on said player cards are of increasing difficulty in said series of games.

19. A method for assigning point scores in an educational word game and learning system for two or more players utilizing a plurality of pairs of words, the words in each pair being related to one another by meaning, or sound, wherein the game includes a set of player cards and a set of word cards, each word card having a word of a respective pair of words imposed on one face thereof, the other word of that pair being imposed on the opposite face thereof, each of the player cards having imposed on one face thereof left and right columns of words, each word of the left column being one word of a respective pair, each word of the right column being the other word of said respective pair, each word in the left column having its corresponding paired word in the right column on the same horizontal line, and a plurality of numbers indicating respective point scores for each word in said left column and each word in said right column, each of the player cards having imposed on a second face thereof left and right columns of words, one column being a repetition of the corresponding column of said one face, the other column having the same words as the other column on said one face but arranged in a scrambled sequence such that the words appearing on the same horizontal line are not properly paired with one another, and a plurality of numbers indicating respective point scores for each word in said one column and each word in said other column, wherein one word card is provided for each pair of words appearing on the player cards, and wherein the point score indicated for each word on said one side of said player cards is the same as the point score indicated for the same word on said second side of said player cards, said method comprising the steps of:

establishing the relative value of said point score for each word so as to be: (a) inversely related to the number of times the letters in said each word appear in all of the words in said plurality of pairs of words, and (b) directly related to the number of letters in said each word; and selecting the sum of the point scores indicated on said player cards to be substantially the same for each player card.

20. The method according to claim 19 wherein the step of establishing includes:

assigning to each letter in the alphabet a weighted value $x=N+C-n$, where N is the number of occurrences of the most frequently occurring letter in all of the words in said plurality of pairs of words, wherein C is a positive constant number, and wherein n is the number of occurrences of said each letter in all of the words in said plurality of pairs of words; and computing the point score indicated for each word as a direct function of the sum S of the weighted values x for all of the letters in each word.

* * * * *